US007395646B2

(12) United States Patent
Salman et al.

(10) Patent No.: US 7,395,646 B2
(45) **Date of Patent: *Jul. 8, 2008**

(54) PORTABLE PACKAGING DEVICE AND METHOD FOR FORMING INDIVIDUALLY PACKAGED ARTICLES

(75) Inventors: Nabil Enrique Salman, Caracas (VE); Stefano Michele Sinigaglia, Mason, OH (US); Robert Paul Cassoni, Dayton, OH (US); Pablo Ibarra, Cincinnati, OH (US); Jose Mauricio Berrizbeitia, Mason, OH (US)

(73) Assignee: The Procters & Gamble Company, Cincinnati, OH (US)

( * ) Notice: Subject to any disclaimer, the term of this patent is extended or adjusted under 35 U.S.C. 154(b) by 1017 days.

This patent is subject to a terminal disclaimer.

(21) Appl. No.: 10/010,391

(22) Filed: Dec. 7, 2001

(65) Prior Publication Data

US 2002/0170275 A1 Nov. 21, 2002

Related U.S. Application Data

(63) Continuation-in-part of application No. 09/745,702, filed on Dec. 21, 2000, now abandoned.

(51) Int. Cl.
*B65B 9/10* (2006.01)

(52) U.S. Cl. ..... 53/567; 53/459; 53/576; 53/390

(58) Field of Classification Search ..... 53/459, 53/576, 567, 415, 417, 449, 479, 136.5, 137.2, 53/574–577, 549, 370, 390; 493/239, 203, 493/214

See application file for complete search history.

(56) References Cited

U.S. PATENT DOCUMENTS

| | | | | | |
|---|---|---|---|---|---|
| 3,111,796 | A | * | 11/1963 | Meissner | 53/483 |
| 3,452,368 | A | | 7/1969 | Couper | |
| 3,461,648 | A | * | 8/1969 | Ashton | 53/576 |
| 3,536,192 | A | * | 10/1970 | Couper | 206/303 |
| 3,908,336 | A | | 9/1975 | Forslund | |
| 3,945,171 | A | * | 3/1976 | Marietta et al. | 53/79 |
| 4,422,215 | A | | 12/1983 | Liekens et al. | |
| 4,446,677 | A | * | 5/1984 | Kokido | 53/577 |
| 4,484,679 | A | | 11/1984 | Liekens et al. | |
| 4,524,561 | A | | 6/1985 | Liekens et al. | |

(Continued)

FOREIGN PATENT DOCUMENTS

EP 0005660 A 11/1979

*Primary Examiner*—Thanh K. Truong
(74) *Attorney, Agent, or Firm*—Jay A. Krebs; George H. Leal; Laura L. Whitmer

(57) ABSTRACT

An article packaging device for packaging articles within a tubular sheet. The article to be packaged is inserted into and enclosed within a length of tubular sheet, and separated from the remaining length of tubular sheet and the device to form the closed individually packaged article. The packaging device is designed to be portable, convenient, lightweight and easily maintained. A thermoplastic, vapor-impermeable tubular sheet having adhesive on one surface can provide an airtight seal that is especially effective when the device is used to package waste-containing disposable adsorbent articles, such as soiled diapers, for disposal. An apparatus for forming the tubular sheet into a layered pack of pleats having an adhesive material positioned on at least one surface.

12 Claims, 7 Drawing Sheets

U.S. PATENT DOCUMENTS 4,550,472 A 11/1985 Temple et al.
4,550,553 A * 11/1985 Gaither ..... 56/202
4,590,749 A 5/1986 Temple et al.
4,648,428 A 3/1987 Story
4,869,049 A 9/1989 Richards et al.
4,934,529 A 6/1990 Richards et al.
5,056,293 A 10/1991 Richards et al.
5,158,199 A 10/1992 Pontius
5,535,913 A 7/1996 Asbach et al.
5,590,512 A 1/1997 Richards et al.
5,655,680 A 8/1997 Asbach et al.
5,662,758 A * 9/1997 Hamilton et al. ..... 156/221
5,782,067 A * 7/1998 Fuss et al. ..... 53/576
5,813,200 A 9/1998 Jacoby et al.
5,890,351 A * 4/1999 Shiotari ..... 53/567
6,065,272 A * 5/2000 Lecomte ..... 53/576
6,128,890 A 10/2000 Firth
6,170,240 B1 1/2001 Jacoby et al.

* cited by examiner

PORTABLE PACKAGING DEVICE AND METHOD FOR FORMING INDIVIDUALLY PACKAGED ARTICLES

CROSS REFERENCE TO RELATED APPLICATION

This application is a continuation-in-part of prior application Ser. No. 09/745,702 filed on Dec. 21, 2000, now abandoned.

FIELD OF THE INVENTION

This invention relates to portable packaging devices useful with a length of non-resilient flexible tubular sheet material dispensed from the device for forming individually packaged articles from separated portions of the tubular sheet, as well as a method for forming a closed individually packaged article from the tubular sheet, employing the portable packaging device.

BACKGROUND OF THE INVENTION

There is a substantial industry worldwide directed to the manufacture and use of packaging for articles of various types. As the world population becomes more mobile, they demand packaging for articles for use both inside and outside the home. For example, articles needed outside the home that can placed into closed individual packaging include personal use articles, such as cosmetics or sanitary products, foodstuffs such as fruits, cereals and sandwiches toys, and business items. Such articles may need to be enclosed in packaging that will remain securely sealed, will not open unexpectedly, will protect the article from moisture and other elements, or will contain undesirable elements of the article such as waste materials and malodor from escaping the package in order to protect the surrounding environment.

There is also a need to package articles acquired or accumulated outside the home, either for disposal or delivery, or for return. Such articles can include ones that may be odiferous and/or contaminated with waste products, including used disposable absorbent articles such as diapers (especially when containing a bowel movement) and sanitary products. Efforts have been made in the past to provide disposal devices that can be used to package such odiferous or contaminated articles until disposed. Such disposal devices have included basic waste pails such as those described in U.S. Pat. No. 5,158,199, issued to Pontius. Other devices include those that employ a mechanical features to dispense and/or enclose a plurality of waste articles into a disposal container, such as those disclosed in U.S. Pat. No. 5,655,680, issued to Asbach et al.; U.S. Pat. No. 5,535,913, issued to Asbach et al.; Pat. No. 6,065,272, issued to Lecomte; U.S. Pat. No. 5,590,512, issued to Richards, et al.; U.S. Pat. No. 6,128,890, issued to Firth; U.S. Pat. No. 5,813,200, issued to Jacoby et al.; EP Publication 0,005,660-A, assigned to Scido; U.S. Pat. No. 3,452,368, issued to Couper; and U.S. Pat. No. 3,908,336, issued to Forslund. One such device is known as the Diaper Genie®, which is disclosed in U.S. Pat. No. 4,869,049, issued to Richards, et al. The product and the patent disclose a receptacle with a hinged closure, and a dispenser for a pack of layered, flexible tubular sheet that is fed into the annular opening of the receptacle. Waste diapers can be inserted into the tubing though the receptacle opening, and can be enclosed by gathering the trailing tubing with a rotatable removable lid that engages the tubing. The device can be replenished with refill tubular sheet from a refill cassette, as described in U.S. Pat. No. 4,934,529, issued to Richards, et al., which discloses a cassette having a layered pack of tubular sheet positioned between a inner tubular core and an outer surrounding wall. The tubular sheet can be dispensed upward through an annular slot in a cap, and into the top opening of the device.

Despite the efforts to improve the packaging of articles, including odiferous and waste contaminated articles, there remains a need for improvements in the portability, flexibility, and effectiveness of devices for forming closed individually packaged articles.

SUMMARY OF THE INVENTION

The invention provides a portable packaging device for manually packaging articles within a tubular sheet, preferably a tubular film that may be closed at one end, sealed at another point and separated from the device. The device has an inlet end and an outlet end, and comprises a body formed by an inner core having an inlet opening and an outlet opening, and a passageway there between. A casing comprising a surrounding casing wall, and an optional base wall, joins the surrounding casing wall to the body. The body and the casing define a storage space and a dispensing opening at the device inlet end. A tubular sheet is disposed within the storage space. The tubular sheet has a length and is designed to be non-resilient and flexible. The tubular sheet can be dispensed through the dispensing opening and into the inlet opening of the inner core. The article can be inserted inside the tubular sheet, and the tubular sheet can be gathered and closed at each end of the article, thereby forming a closed packaged article.

The device also comprises a means for separating the closed packaged article from a trailing portion of the tubular sheet, to remove the closed individually packaged article through the outlet opening, for disposal or other purpose. The device does not include a receptacle or container integral with the device for receiving the separated, closed packaged article. The means for separating the closed individually packaged article from the remaining trailing tubular sheet enables immediate disposal, storage, or utilization, of the packaged article. The portable packaging device is designed to be convenient, portable, lightweight and easily maintained.

A preferred packaging device further comprises a layered pack of the flexible tubular sheet 51. The tubular sheet 51 may preferably be made from a flexible thermoplastic tubular film. More preferably, the tubular sheet or film has an inner surface that will face inward when the tubular film is passed through the inner core, the inner surface comprising an adhesive material at least intermittently applied thereto, whereby a leading portion and a trailing portion of the tubular sheet can be gathered on each side of article and closed with the adhesive material, thereby forming a sealed package article.

BRIEF DESCRIPTION OF THE DRAWINGS

The various advantages of the present invention will become apparent to skilled artisans after studying the following specification and by reference to the drawings in which.

DETAILED DESCRIPTION OF THE INVENTION

The Portable Packaging Device

Figure 1:
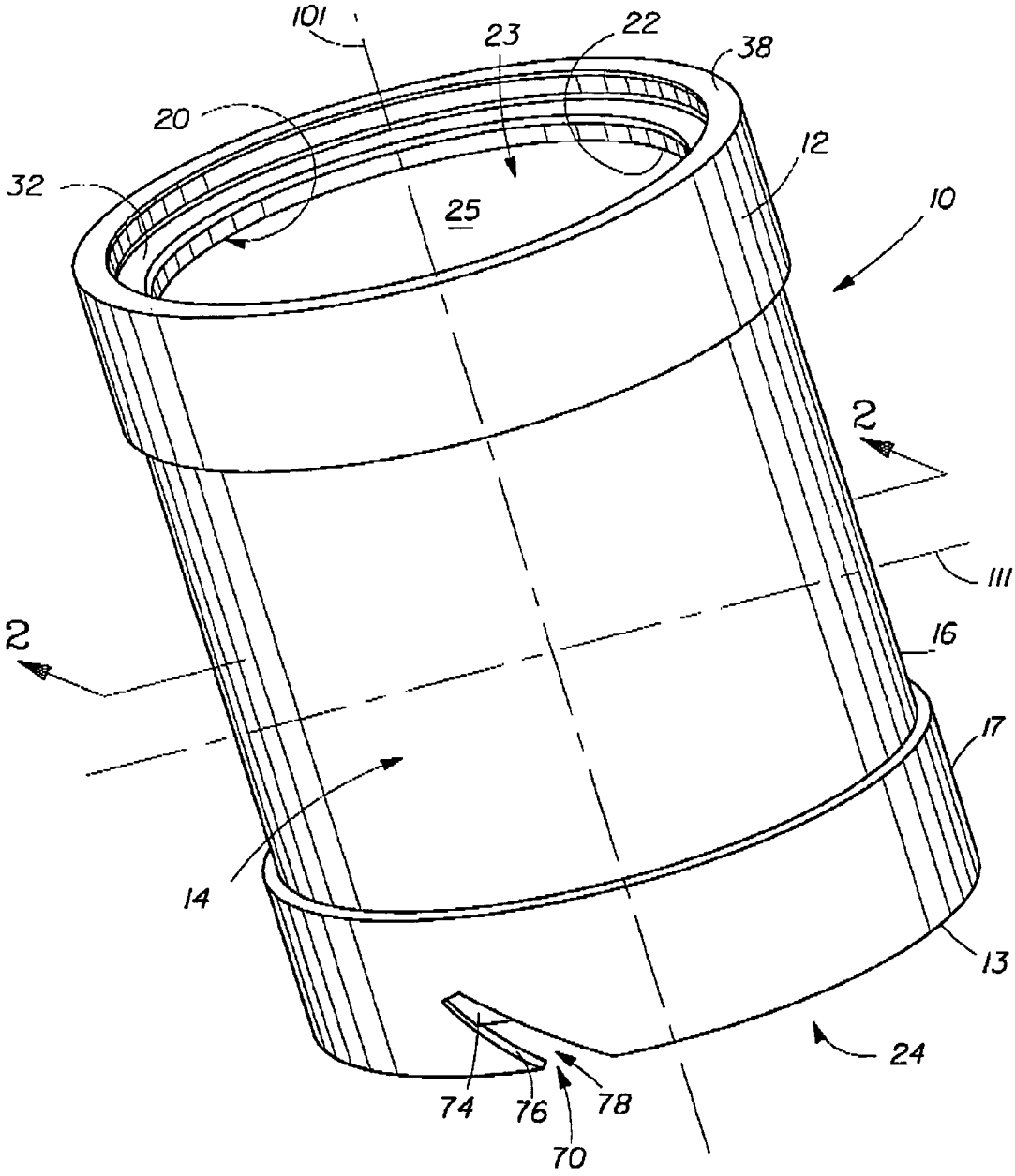
FIG. 1 is a perspective view of one embodiment of the portable dispensing device.

As shown in FIG. 1, the article packaging device 10 may include an interior body 20, which forms the interior structure of the device and an exterior casing 14, which forms the exterior structure of the device 10. The body 20 may be formed of an inner core 22 having an inlet opening 23 at the inlet end 12 and an outlet opening 24 at the outlet end 13, with a passageway 25 there between. The exterior casing 14 may comprise a surrounding casing wall 16 along at least part of the exterior dimension of the device 10.

Figure 2:
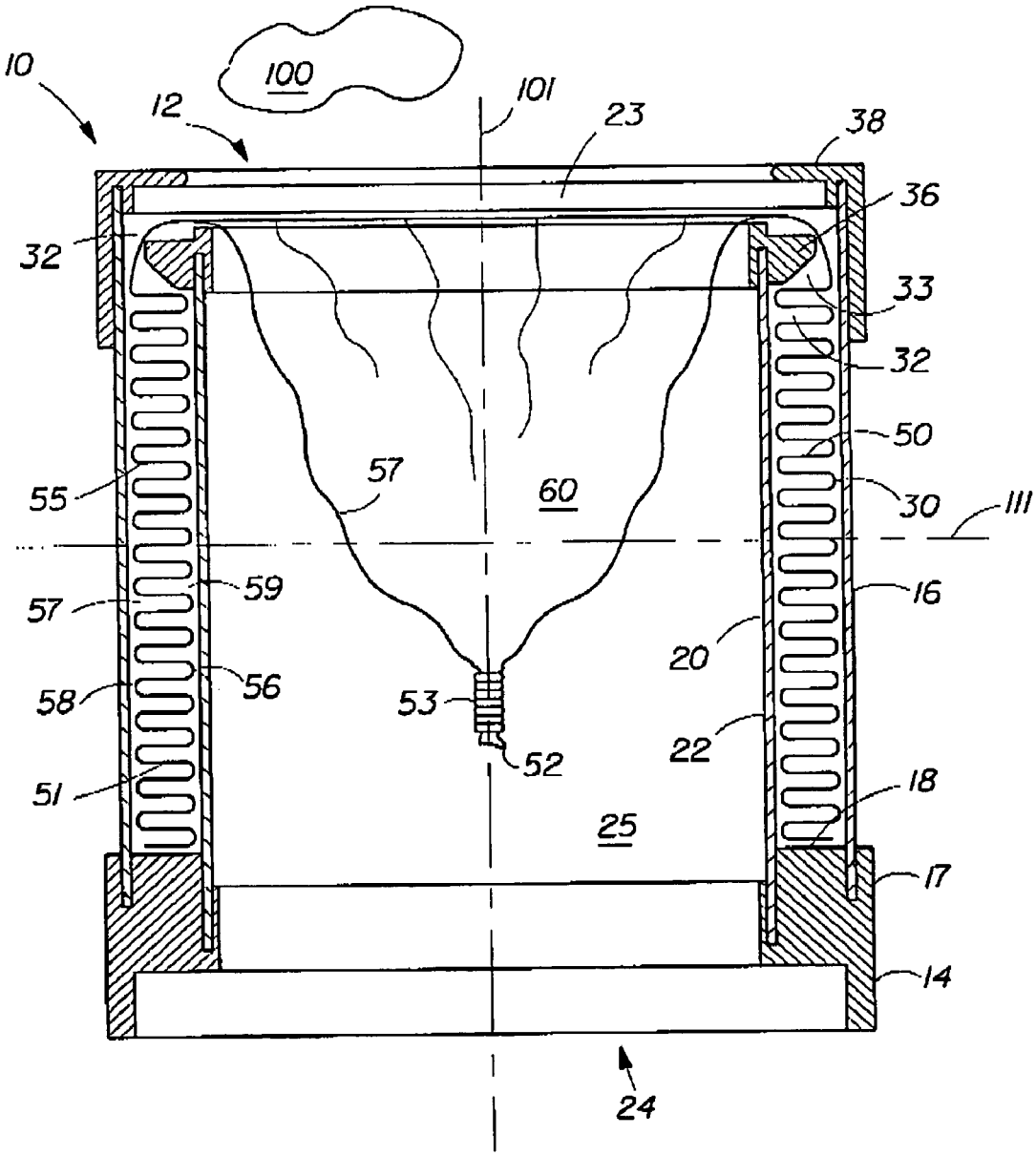
FIG. 2 is a vertical cross-sectional view of the portable dispensing device of FIG. 1, containing the length of tubular sheet.
Figure 3:
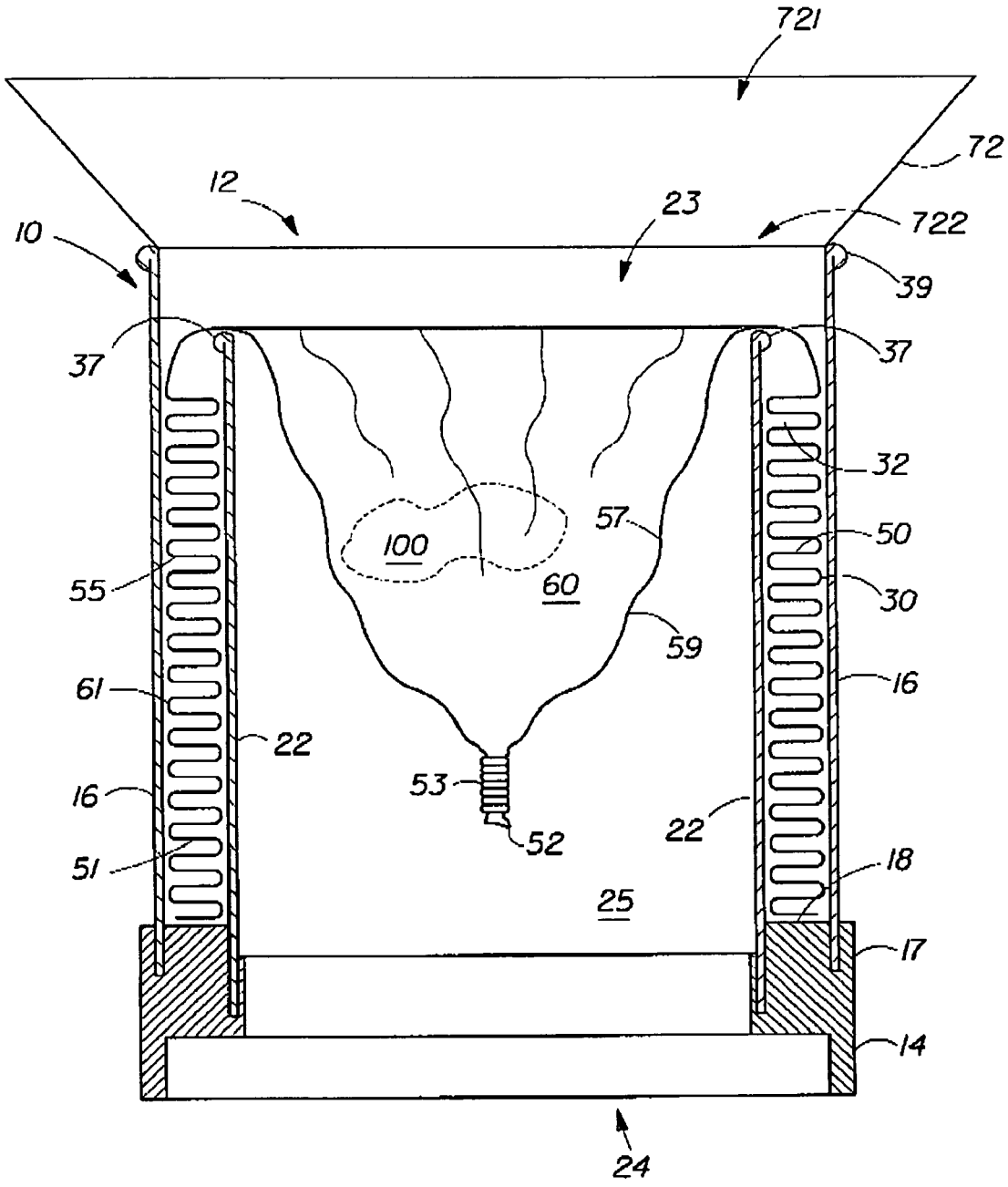
FIG. 3 is a vertical cross-sectional view of an embodiment of the portable dispensing device.

As shown in FIG. 2, the exterior casing 14 may also comprise a generally horizontal base wall 18. The base wall 18 may form an end 17 to the device 10 for attachment to the interior body 20 at either the inlet opening 23 or the outlet opening 24. Preferably, the end 17 is attached at the outlet opening 24. The interior body 20 is generally parallel to and incased by the casing wall 16, forming between them a storage space 30. The exterior casing 14 (with or without the base wall 18) may attach to the interior body 20, such that the casing wall 16 encases the passageway 25. The base wall 18 and/or the end 17 of the surrounding casing wall 16 may join with the body 20. The casing 14 and the body 20 define a storage space 30 there between, as well as a dispensing opening 32 near an inlet end 12. A flexible tubular sheet 51, having a length and a circumference, occupies the storage space 30. The flexible tubular sheet 51 is used to surround and package an article 100. As shown in FIG. 2, the dispensing opening 32 has an annular gap 33 out through which a leading portion 52 of the tubular sheet 51 can be dispensed from the storage space 30. The article 100 to be packaged is inserted into the device 10 through the inlet opening 23, passes through the passageway 25, during which it is enclosed in the tubular sheet to form the packaged article 105. The article 100 is passed through the outlet opening 24, sealed, and separated from the device 10. The device 10 has a vertical axis 101 along the symmetrical center of the passageway 25 as shown in FIG. 1, FIG. 2 and FIG. 3. The device 10 also has a horizontal axis 111 perpendicular to the vertical axis as shown in FIG. 1, FIG. 2 and FIG. 3. In one embodiment, the device has a compact dimension of a height along the vertical axis 101 of less than 20 centimeters and a width along the horizontal axis 111 of less than 17 centimeters.

The horizontally viewed cross-sectional shape of the passageway 25 may be circular, as shown in FIG. 1. The shape of either or both the inlet opening 23 and outlet opening 24, can alternatively be any closed circumference shape, including circular, or preferably oval (elliptical). It has been found that providing an outlet opening 24 and at least a portion of the passageway 25 that are oval or elliptical can accommodate the human hand or fingers more readily than a circular shape. The passageway 25 can be cylindrical along the vertical axis 101. A vertical axis 101 along the passageway 25 may be a straight line as shown in FIG. 1, or alternatively, elbowed, curved or non-linear. The selection of the shape and orientation of the passageway 25 and openings can depend on design and aesthetic considerations of the use of the device 10.

As shown in FIG. 2, the casing 14 retains the tubular sheet 51 to prevent it from falling out though the dispensing opening 32 during use. An annular retainer cap 36 can be attached to the casing 14 or the body 20. FIG. 2 shows the annular retainer cap attached to the body 20. The cap 36 may also be integral with either the casing 14 or the body 20, or both. The cap 36 covers a portion of the dispensing opening 32, thereby preventing the tubular sheet 51 from falling out of the storage area 30 while in use. As shown in FIG. 2, the annular retainer cap 36 may be an attachable annular ring attached to the inlet end 12 of the inner core 22 and extending radially outward in the horizontal direction into the dispensing opening 32, leaving the annular gap 33 out through which the tubular sheet 51 may be dispensed.

Another preferred embodiment, shown in FIG. 3, provides an inner core 22 comprising an inner core rim 37 along the inner core 22 at the inlet end 12, which can be formed by rolling the wall material of the inner core 22 outwardly in a horizontal axis 111 direction. The inner core rim 37 may also be a separate small-radius rim made from plastic, metal, or other suitable material. The inner core rim 37 preferably comprises a smooth, curved surface to reduce the drag force upon the tubular sheet as a pleat 61 unfolds and passes out of the dispensing opening 32 and into the inlet opening 23 of the passage 25. The tubular sheet 51 is stored between the inner core 22 and the casing wall 16 of casing 14 may extend from the casing end 17 and/or base wall 18 up through the storage space 30, over the inner core rim 37 and into the passageway 25.

As shown in FIG. 1 and 2, the device 10 can comprise an annular protective cap 38, positioned to cover the dispensing opening 32 from the inlet direction. The protective cap 38 can be detachably or integrally affixed to the casing 14. The protective cap 38 can prevent other objects, as well are debris, dirt and liquids from spilling down onto the device 10 and in through the exposed dispensing opening 32. The protective cap 38 also serves as a convenient base on which other objects might be placed and stacked upon the device 10. The protective cap 38 is particularly useful when using tubular sheet 51 with adhesive on an inner surface 57. The protective cap prevents contact and contamination of the inner surface 57 that is exposed and facing upward as the tubular sheet 51 is dispensed over the retaining cap 36 and into the passageway 25, as shown in FIG. 2.

FIG. 3 shows a device 10 with a layered stack 55 an outer casing wall 16 comprising a casing wall rim 39 along the casing wall 16 at the inlet end 12, which can be formed by outwardly rolling the wall material of the casing wall 16. The casing wall rim 39 may also be a separate small-radius rim made from plastic, metal, or other suitable material. The casing wall rim 39 preferably comprises a smooth, curved surface, and is preferably rolled outwardly, to receive a removable lid (not shown) that can fit over the casing wall rim 39, to cover the inlet end 12 of the device 10. The removable lid is preferably made of a flexible, resilient plastic.

The components parts of the device 10, including the body 20, inner core 22, casing 14, retaining cap 36, and protective cap, are preferably made of resilient plastics, including but not limited to polyethylenes (PE) (including high density polyethylene, HDPE), low density polyethylene, LDPE and linear low density polyethylene, LLDPE), polypropylene (PP), polyethylene terephthalate (PET), polyvinyl chloride (PVC), polyvinylidene chloride (PVDC), latex structures, nylon, and surlyn, although other rigid, resilient materials (e.g., fiberboard, sheet metal) can be used.

To facilitate the convenient handling of the device by hand, and to carry it about, the device can optionally comprising a handle either integrally formed with or detachable from the device 10. The device 10 can also comprise a mounting element for removably securing the device 10 to a corresponding receiver element positioned on a wall, tabletop, etc.

To facilitate grasping and holding of the device during transport or use, the outer casing wall 16 can be covered with an anti-slip material, such as a rubber coating. The casing wall 16 can also be formed with ribs, ridges, nubs, protrusions, or other surface aberrations to facilitate an improved grip with less slippage in the hand.

As shown in FIG. 2 the tubular sheet 51 is preferably formed into a layered stack 55 of pleats 61 where the tubular sheet 51 has been repeatedly folded alternately inward (to form an inner fold edge 56) and outward (to form an outer fold edge 58). The resulting layered stack 55 of tubular sheet 51 may be disposed between the inner core 22 and the exterior casing wall 16.

Figure 4:
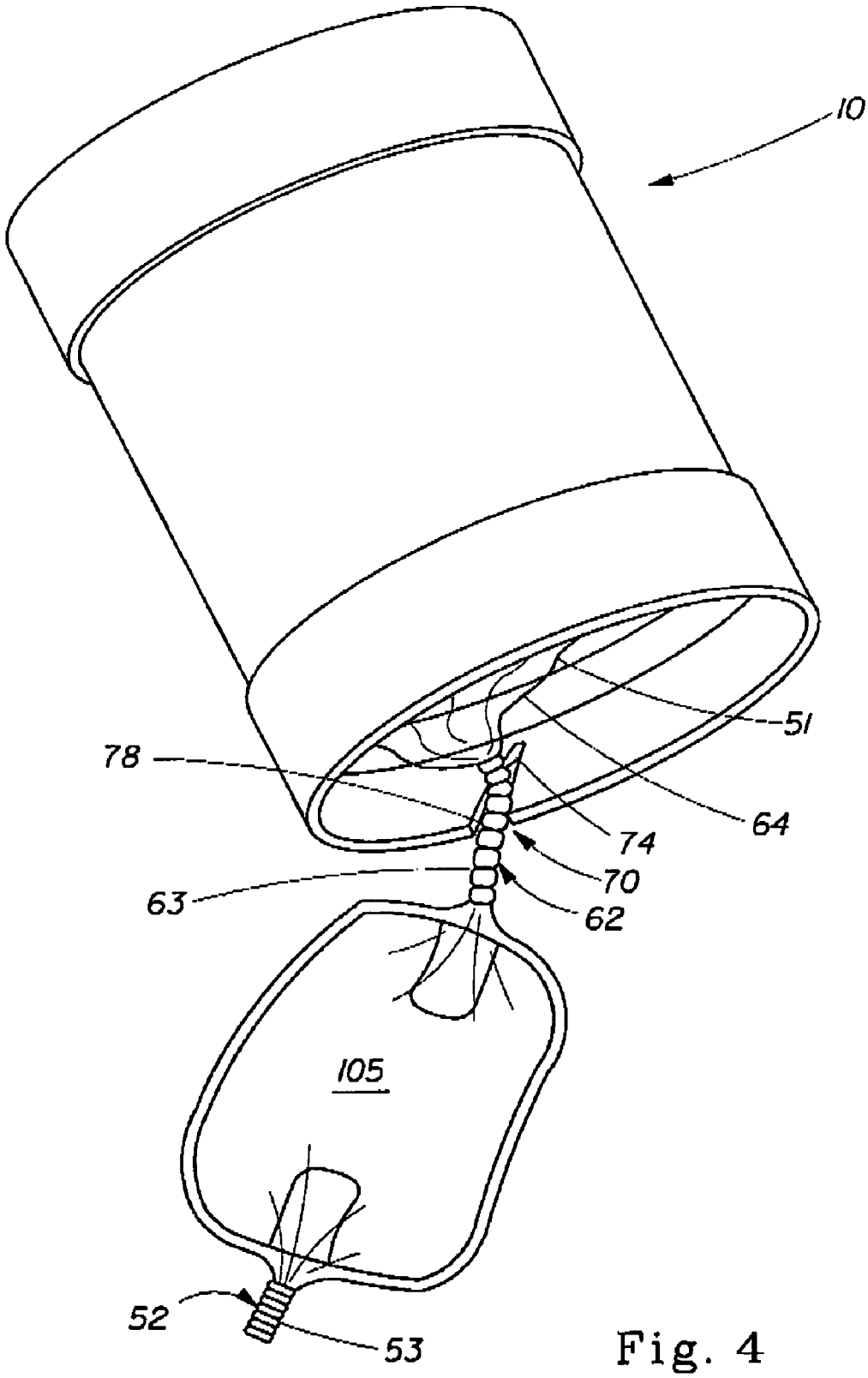
FIG. 4 is a perspective view of one embodiment of the device from the bottom, with a closed packaged article to be cut from the further trailing portion of the tubular sheet.
Figure 5:
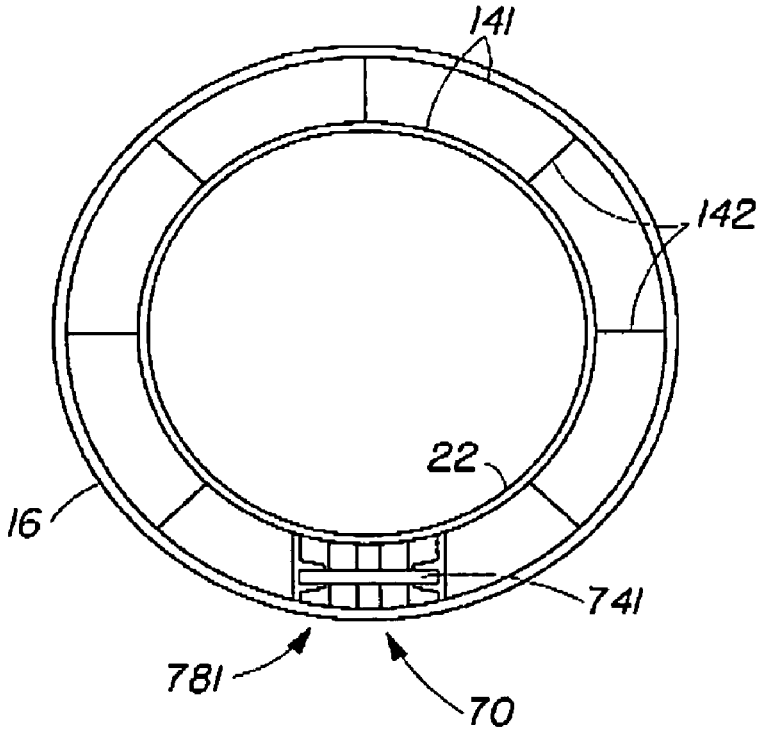
FIG. 5 is a horizontal view of an embodiment of the portable dispensing device from the outlet end.

As shown in FIG. 4, the device 10 may also comprise a means for separating the closed packaged article 105 from the further trailing tubular sheet 64. A preferred separating means comprises a cutting means 70, such as a saw or a knife-like cutting blade 74 shown in FIG. 1 and FIG. 4. The cutting blade 74 cuts through the gathered, closed tubular sheet 51 behind the article 100 as shown in FIG. 4. The cutting blade 74 can be a separate metallic blade, affixed, casted or molded into the device, or can be a blade formed integrally from the material of the body 20, casing 14, or both. In one embodiment shown in FIG. 5 and FIG. 6, the cutting means 70 may include a cutting blade 741 located between the inner core 22 and the casing wall 16 in a slot 781 at the outlet end 13. The cutting blade 74 shown in FIG. 1 and FIG. 4 may be parallel to the horizontal axis 110 or at some angle. Preferably, the cutting blade 74 is at an angle of about +30 degrees or more to the horizontal axis 110.

The cutting blade 74 is preferably attached to a rigid plastic material. The cutting blade can also be a serrated blade or a blade having individual cutting teeth, such as one described in U.S. Pat. No. 5,839,634. Preferably, the end 17 is attached at the outlet opening 24 with the passageway 25 being generally parallel and incased by the casing wall 16, forming a storage space 30 between them. The cutting means 70 is preferably positioned at the outlet end 13 of the device 10, and can be integrally formed into a portion of the inner core 22 or the casing 14, as shown in FIGS. 1 and 4. The cutting means 70 may also be located at the inlet end 12 of the device 10.

Figure 6:
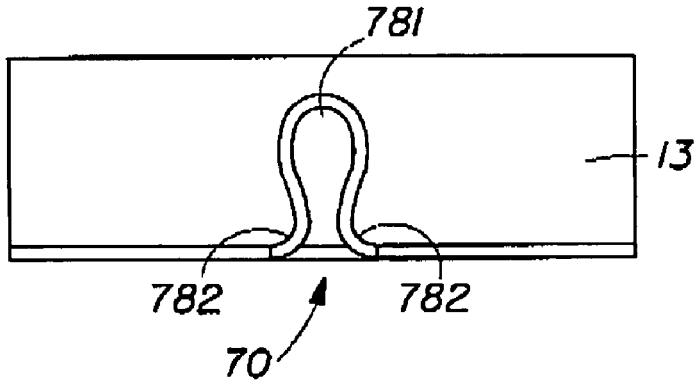
FIG. 6 is a vertical view of an embodiment of the slot at the outlet end.

The slot 78 may be located in a double walled casing 141 as shown in FIG. 6. The casing 14 may also be solid. The double walled casing 141 may include locking ribs 142 to improve the structural sturdiness of the portable packing device 10. Locating the slot in the casing 141 may help ensure sufficient gathered tubular sheet 51 on each side of the cutting means. The slot 78 shown in FIG. 1 may be any shape that allows the tubular sheet 51 to contact the cutting means 70. The slot 78 may be oriented at any angle to a vertical axis 100 or a horizontal axis 110. Preferably, the slot 78 is configured to conceal the cutting means in order to protect the cutting means from damage and to prevent it from inadvertently cutting other items. The slot 78 may be angled as shown in FIG. 1 to protect a cutting blade 74.

Optionally, a cutting means can be integrated with a gather compression means to both close and separate the packaged article 105 in one continuous step. For example, the slot 78 in FIG. 4 may be contoured to apply pressure to the tubular sheet 51 as it is inserted in the slot 78 in order to improve the seal at the gathered leading portion 53 and gathered trailing portion 63. One example is a horseshoe-shaped slot 781 such as the one in FIG. 6. The slot 781 has at least two pinch points 782 that help properly seal the tubular sheet 51 on both sides of the cut made by the cutting means as the gathered trailing portion 63 is inserted into the slot as shown in FIG. 4. With the article separated from the device 10, the resulting leading portion 52 is gathered and sealed to form a new gathered leading portion 53 and a new pouch 60.

In one embodiment, the tubular sheet 51 will have separable regions along its length, generally through the circumference of the tubular sheet 51, that are positioned between remaining lengths of the tubular sheet. The separable regions can be manually opened by tearing or forcefully pulling the sheet on either side of the separable region, thereby separating one portion of the tubular sheet from another portion along the separable region. The separable region can by torn or ruptured by hand more easily than can the remaining portions of the tubular sheet 51. The separable region can comprise one or more lines of weakening around at least a portion of, though preferably entirely around, the circumference of the separable region, and can comprise perforations, score lines, and combinations thereof. The separable region can also comprise a region of the tubular sheet 51 that is thinner, or is made of a more weakened material, than that of the remaining tubular sheet 51. This permits manual separation of the closed individually packaged article 105 from the remaining length of tubular sheet 51 without resort to a cutting element, scissors, etc.

The device 10 can optionally include a funnel member 72 as shown in FIG. 3. The funnel member 72 can attach to, or rest upon, the casing wall 16 at the inlet end 12 to facilitate the insertion of articles 100 in through the inlet opening 23. The funnel member 72 has a wide inlet opening 721 and a narrow outlet opening 722. The outlet opening 722 may be aligned with the inlet opening 23 of the inner core 22, or the casing wall rim 39 as shown in FIG. 3. The tubular sheet 51 may be dispensed from the storage space, passed up and over the wide inlet opening, down through the funnel and in through the inlet opening 23. Alternatively, the funnel member 72 may attach over the tubular sheet inner surface 57 as shown in FIG. 3.

The tubular sheet 51 can be any flexible sheet material that has been formed into a tubular shape. The tubular sheet material is preferably non-resilient so that it can take and retain more easily any shape into which it is formed. The tubular sheet material can be partially or entirely, transparent, translucent, or opaque. The sheet material can be formed into a tubular form by well-known methods. Preferred tubular sheet materials are thermoplastic non-resilient flexible films. For waste article disposal use, the more preferred materials are thermoplastic, vapor-impermeable film materials, fabricated from a polymer that can be made from homogeneous resins or blends thereof. Single or multiple layers within the film structure are contemplated, whether co-extruded, extrusion-coated, laminated or combined by other known means.

Useful resins for making the tubular sheets 51 include, but are not limited to, polyethylenes (PE) (including high density polyethylene, HDPE, low density polyethylene, LDPE and linear low density polyethylene, LLDPE), polypropylene (PP), polyethylene terephthalate (PET), polyvinyl chloride (PVC), polyvinylidene chloride (PVDC), ethylene vinyl acetate (EVA), latex structures, nylon, and surlyn, and mixtures and blends thereof A preferred resin is a blend of EVA and polypropylene. Other suitable tubular sheet materials include, but are not limited to, aluminum foil, coated (waxed, etc.) and uncoated paper, coated and uncoated wovens, scrims, meshes, nonwovens, and perforated or porous films, and combinations thereof The tubular sheet material can also be a three-dimensionally shaped formed film. Three-dimensionally shaped formed films may have a film thickness of from about 0.0001 inch (0.1 mil) to about 0.009 inches (9 mil), more preferably about 0.5 mil to about 2 mil.

A preferred tubular sheet 51 includes an adhesive material. The adhesive material may be applied to the inner surface 57, the outer surface 59, or to both surfaces of the tubular sheet 51. FIGS. 2 and 3 show the inner surface 57, and the outer surface 59. Preferably the adhesive is applied to the inner surface. The adhesive may be applied, or positioned on the inner surface 57 and/or the outer surface 59 continuously or intermittently. The adhesive is designed to facilitate the closing of the gathered leading portion 53 and the gathered trailing portion 63 of the tubular sheet 51 around the article 100.

Adhesive applied to a surface of the tubular sheet 51 can contact and adhere to film processing machine parts, and to other objects and surfaces. In addition, the adhesive can cause the tubular sheet layered stack 55 to adhere together. If the adhesive force is significant, it can cause problems with the dispensing of the tubular sheet 51 from the dispensing device 10. To inhibit or prevent the adhesive from prematurely contacting and bonding within or around the layered stack 55, the adhesive is preferably positioned away from the effective inner surface 57 and/or outer surface 59 of the tubular sheet to avoid activating the adhesive. This may be achieved with a tubular sheet 51 made from a three-dimensional film. The adhesive may be placed into the valleys of the three-dimensional film such that the adhesive does not contact other portions of the tubular sheet 51.

A preferred three-dimensional film having an adhesive applied on one surface for use as the tubular sheet 51 is described in U.S. Pat. Nos. 5,871,607 (Hamilton et al.), 5,662,758 (Hamilton et al.), 5,968,633 (Hamilton et al.), and 5,965,235 (McGuire et al.), the disclosures of which are incorporated herein by reference. The three-dimensional film has an inner surface that comprises a plurality of recessed pressure sensitive adhesive sites and a plurality of collapsible protrusions that serve as stand-offs to prevent premature sticking of the adhesive sites to a target surface until a force sufficient to collapse the protrusions has been applied to the opposed surface of the three-dimensional film. When using a three-dimensional film comprising a plurality of adhesive sites and collapsible protrusions, the three-dimensional film will close and seal securely at the gathered leading portion 63 and gathered trailing portion 63. The film can also be adhered to the enclosed article by firmly impressing the film against the packaged article 105 as shown in FIG. 4. This can provide advantages, in preventing the packaged article(s) 105 from moving about within the tubular sheets, and in making the closed individually packaged article 105 more rigid, and thereby more resistant to premature loosening and opening of the gathered closures. A preferred adhesive material is a pressure-sensitive adhesive material.

Another technique provides support structures such as ridges onto the surface of the tubular sheet 51 to support the tubular sheet 51 (and hence the adhesive surface) away from itself when formed into pleats. Another support structure may include a plurality of fibers extending away from the tubular sheet and beyond the surface of the adhesive. The fibers exert a stand-off force against a target surface to avoid premature adhesion of the tubular sheet 51 to itself or other items until an activation force provided by the user is applied sufficient to collapse the fibers or ridges. Such a sheet material is disclosed in U.S. provisional patent application 60/301028, filed Jun. 26, 2001.

The tubular sheet 51, having an adhesive material applied on a surface, such as those described above, will resist adhesion to itself or to other surfaces including the dispensing device 10, prior to closing and sealing the gathered film around the closed packaged article. Generally, the tubular sheet 51 should resist or avoid premature adhesion when formed or stored in the layered stack 55. The tubular sheet 51 will typically not adhere to itself (adhesive-bearing surface to adhesive-bearing surface) when exposed to a pressure of 200 grams force or less over a 1 square centimeter area of the sheet material (200 gm/cm$^2$), more preferably of 280 gm/cm$^2$ or less, even more preferably of 500 gm/cm$^2$ or less, and most preferably of 630 gm/cm$^2$ or less. A tubular sheet 51 thermoplastic film having an adhesive applied on a surface provides improved odor properties as compared to the thermoplastic film alone, without the adhesive. Odors that are contained in, or that form by chemical reaction within, the closed packaged article 105 are less noticeable than when packaged within the same tubular sheet 51 of thermoplastic film without the adhesive. Without being bound to any theory, it is believed that the adhesive serves as a transmission barrier to, or as an absorbent of, the odor compounds.

The adhesive material may also be applied between the tubular sheets 51 where a multilayered tubular sheet 51 is used. This may be used to improve the ease of manufacture or reduce inadvertent adhesion between portions of the tubular sheet 51. The inner layer may be designed to assist keeping the adhesive off of the manufacturing equipment but also be penetrable by the adhesive when a user wishes to secure the tubular sheet about an article. In this application the tubular sheet may be permeable or otherwise capable of allowing the adhesive to be used. For example, the inner tubular sheet may be either permeable or easily made permeable through twisting or deformation.

The length 50 of tubular sheet 51 retained within the device 10 is most preferably in a layered stack 55, consisting of a plurality of pleats 61 formed by repeatedly folding the tubular sheet 51 inwardly and outwardly as shown in FIG. 2 and FIG. 3. The use of a tubular sheet having an adhesive on one surface can require special consideration in the design and use of the packaging device 10. A tubular sheet 51 having adhesive on the inner surface 57 or outer surface 59 should try to avoid contacting or pulling the adhesive surface across edges or surfaces of the device 10, such as the casing 14, the retainer cap 36, and the inner core rim 37. For this reason, tacky adhesives should be avoided, in favor of pressure-sensitive adhesives and three-dimensional tubular films having an adhesive surface that is recessed. The adhesive can be food grade or not food grade. A preferred adhesive is a hot melt adhesive that is light colored, has a viscosity in the range of 1,500 to 36,000 cP measured within a temperature range of 270° F. to 350° F., and a softening point temperature in the range of 100° F. to 350° F.

The tubular sheet 51 can also comprise other ingredient materials that provide aesthetic or functional benefits. Such aesthetic ingredients can include, by example, colorants and opacifiers to improve the appearance of the tubular sheet 51 and to make the tubular sheet 51 translucent or more opaque; perfumes or other chemicals to provide a pleasant or masking odor; and insecticides to repel or reduce the attraction of insects such as flies. Such ingredient materials can be incorporated into or placed onto the surface of the tubular sheet 51, or within an adhesive material position on the surface of the tubular sheet 51. Such colorants, opacifiers, perfumes and insecticides can be ones commonly used and well known to those persons knowledgeable in these arts.

The layered stack 55 can be inserted or removed from the device 10 though either the inlet end 12 or the outlet end 13 of the casing 14, by removing either the annular retainer cap 36, or the base wall 18, respectively. Alternatively, the exterior casing 14 and interior body 20 may be separated. The layered stack 55 may also be placed over the inner core 22 prior to the core being joined or rejoined to the casing 14. In FIG. 2, a refill of layered stack 55 can be inserted most conveniently by removing the protective cap 38 and the annular retainer cap 36. The layered stack 55 refill pack can consist simply of a pack of film that is constrained by any means including ties or shrink wrapping. The refill pack of layered stack 55 may be inserted into the storage space before or after the ties and constraints are removed. Alternatively, a portion of the refill pack can comprise a replacement inner core or parts or the whole of the casing, which replace corresponding parts on the device.

The layered stack 55 can be formed for the refill pack, or prepackaged in the packaging device 10, by well-known methods, such as described in U.S. Pat. No. 5,056,293, issued to Richards et al., incorporated herein by reference. In a preferred process, the tubular sheet length 50 has adhesive positioned on an inner surface 57 when fed and packed into the layered stack 55 configuration. One preferred process comprises feeding the tubular sheet 51 by engaging the length of tubular sheet 51 on its outer surface 59 (the surface without adhesive) when forming and layering the plurality of pleats into a tubular layered stack 55. The tubular sheet 51 may be formed by any means known in the art. One method is to provide a flat sheet of flexible plastic film over a forming horn. Once formed into a tube, the sheet may then be sealed along a seam to form a tube. The seam may be created by any known means including a heated sealing roller, ultrasonic bonding or adhesive.

To manufacture a layered stack 55, the tubular sheet 51 runs outside and over a cylindrical feed mandrel having a plurality of vertical slots cut from its base up toward the feed end. Inside the slotted mandrel is a reciprocating piston with a plurality of fingers, which can extend through the slots. This piston is driven by a cam mechanism and moves axially up and down within the slotted mandrel. The fingers are controlled by an eccentric (mounted on the cam) and a series of link arms. The link arms and eccentric allow the fingers to move in and out as the eccentric rotates (i.e., the effective circumference of the fingers changes as the eccentric rotates). The packing motion of this reciprocating device is: (1) piston moves up with retracted fingers, (2) fingers extend, (3) piston moves down with fingers extended, (4) finger retract. This differential circumference of the fingers as they extend and retract is what allows the reciprocating device to grab and release the tubular sheet 51 as pleats 61 of the tubular sheet 51 are formed in the annular space between the two mandrels. The film is stacked in the annular space onto a base comprising a pair of indexing jaws. These jaws index down throughout the process so the distance between the fingers at the bottom of their stroke and the top of the packed pleated tubing is always constant. When the desired amount of pleated tubular sheet has been formed, the feed tubing is cut, and the indexing jaws separate, move upward above the pleated pack, close, and move downward, thereby pushing the layered pack of tubular sheet 51 from around the slotted mandrel.

One apparatus suitable for forming a pleated layered pack of tubular sheet from a length of flexible tubular sheet material may comprise a central mandrel, a base, and a means for feeding the tubular sheet onto the mandrel. The a central mandrel having a sheet receiving end and a base end, an external circumference determined by an internal diameter for each layered pack, and a plurality of slots positioned circumferentially around the central mandrel and extending axially from the base end and ending toward the sheet receiving end. The base is positioned at the base end of the central mandrel. The means for feeding the tubular sheet onto the central mandrel in pleated layers comprises an engaging means, and extending means, and a drive means. The engaging means is registered with each slot, having an extended position extending through the slot to contact the inner surface of the tubular sheet and a retracted position within the central mandrel. The extending means moves the engaging means radially between the extended position and the retracted position. The reciprocating means moves the engaging means axially between a pickup position near the tubular sheet receiving end of the slot, and a deposit position toward the base end. The drive means drives (moves) the extending means and the reciprocating means in synchronized timing. The engaging means proceeds through a cycle of the extended position at the pickup position, the extended position at the deposit position the retracted position at the deposit position, the retracted position at the pickup and back again. The extended position at the pickup position engages the inner surface of the tubular sheet. The extended position at the deposit position pulls the tubular sheet down to form a pleated layer. The retracted position at the deposit position disengages from the inner surface of the pleated tubular sheet. The retracted position at the pickup returns to the beginning of the cycle, forming the pleated layered pack of tubular sheet.

An alternate apparatus for packing a tubular sheet with adhesive on one surface comprises an indexing means by which the relative distance between the pickup position and the deposit position of the engaging means is maintained substantially constant. The indexing means preferably comprises a means for indexing the base axially downward from the deposit position, substantially by a distance equal to the thickness of a formed pleat 61 (which is essentially twice the thickness of the tubular sheet 51). The apparatus can also comprise a means for holding the formed pleat 61 as the engaging means disengages and returns to the pickup position to engage a subsequent length of tubing for the next pleat 61. The holding means can comprise a plurality of fingers that extend through additional holding slots in the central mandrel to hold the inner surface of the tubular sheet, or can comprise a means to hold the outer surface 59 of the tubular sheet. When the apparatus will form a series of layered packs of tubular sheet 51, the apparatus will further comprise a means for severing the layered portion of the tubular sheet 51 from a remaining portion of the tubular sheet 51, and a means for discharging the severed tubular sheet 51 from around the central mandrel as a layered pack.

The construction of machines and systems to form the tubular sheet 51 into a layered pack preferably minimizes the forces against the adhesive layer, such as sharp transition points, to reduce adhesive build-up on the machine parts.

Figure 7:
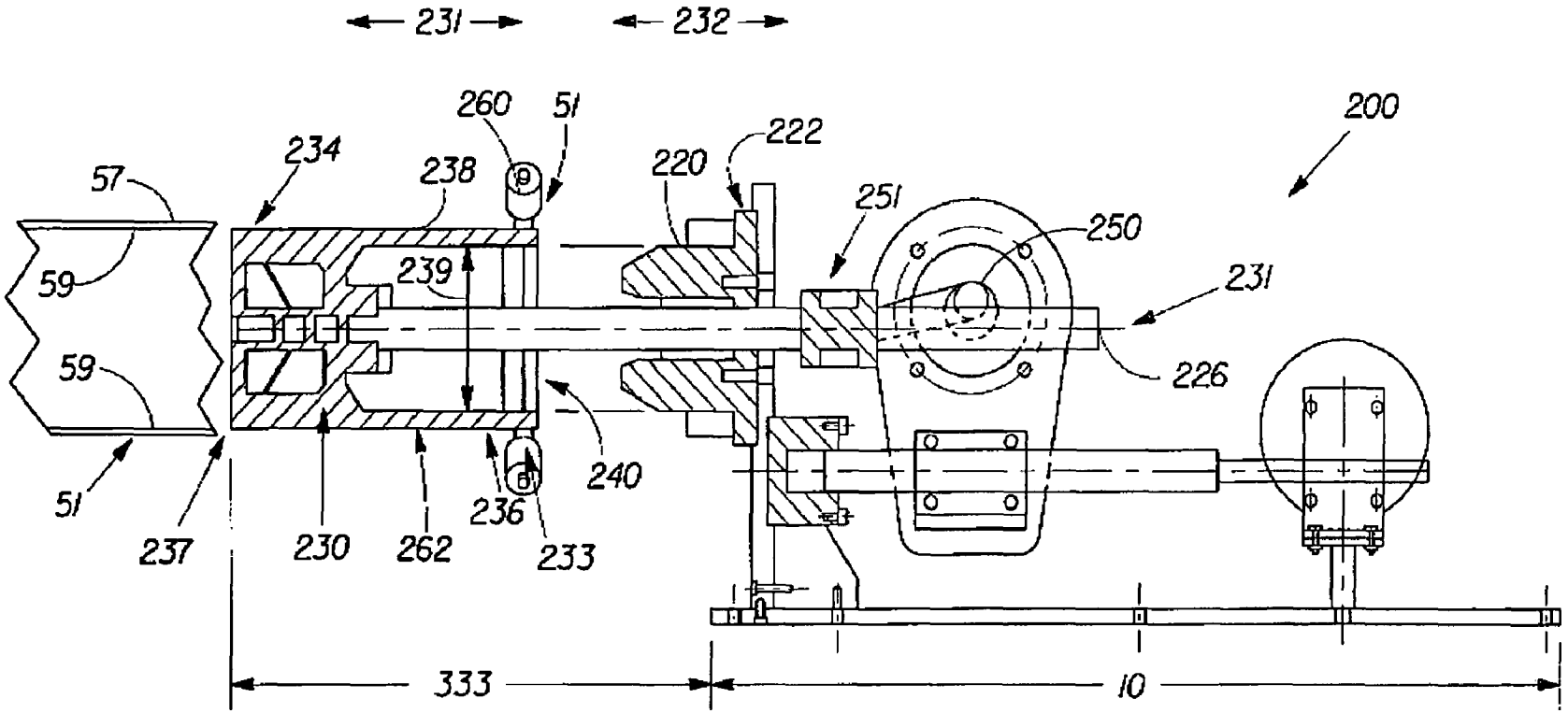
FIG. 7 is a view of a pleating apparatus in a base position.
Figure 8:
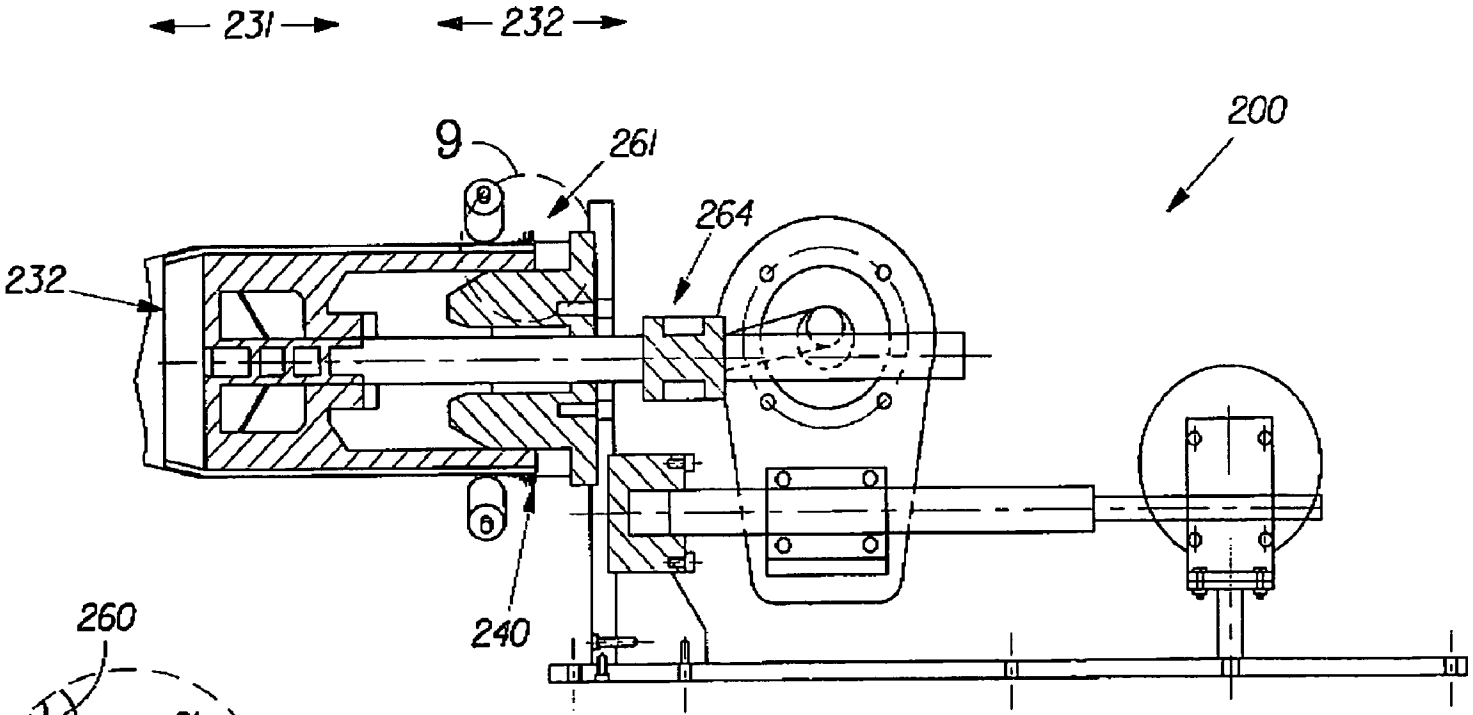
FIG. 8 is a view of a pleating apparatus in a forward position.

Another preferred process and apparatus 200 shown in FIG. 7 and FIG. 8 is designed to form a pleated layered pack of tubular sheet from a length of flexible tubular sheet material. The apparatus 200 engages the tubular sheet 51 with an internal plunger 230 that reciprocates by a reciprocating means 250. The plunger 230 pulls down a pleat 61 over a mandrel 220 with each stroke or cycle. FIG. 7 shows the apparatus in the forward position 231 with the mandrel 220 and plunger separate. FIG. 8 shows the plunger 230 and the mandrel 220 in the base position 232 with the two together.

The central mandrel 220 in FIG. 7 may have a mandrel base end 222, and a central mandrel axis 226. The plunger 230 may have a tubular sheet receiving end 234, a plunger base end 237, a plunger forward end 233, plunger external diameter 238, and a plunger internal diameter 239. The plunger internal diameter 239 defines a mandrel space 225. The plunger forward end 233 has an outer ring 235 having a diameter 236. The outer ring 235 is designed to engage the inner surface 57 of the tubular sheet 51 when the plunger 230 moves from the forward position 231 toward the base position 232, whereby the tubular sheet 51 engaged by the outer ring 235 and pulled toward the base position 232 can be formed into a pleat 61 as shown in the close up view in FIG. 9. The plunger 230 is capable of movement within the mandrel space 225 and along the central mandrel axis 226 between a forward position 234 and a base position 232. In FIG. 7, the reciprocating means 250 has a connector 251 affixed to the plunger 230, for reciprocating the plunger 230 along the central mandrel axis 226 between the forward position 234 and a base position 232.

Figure 9:
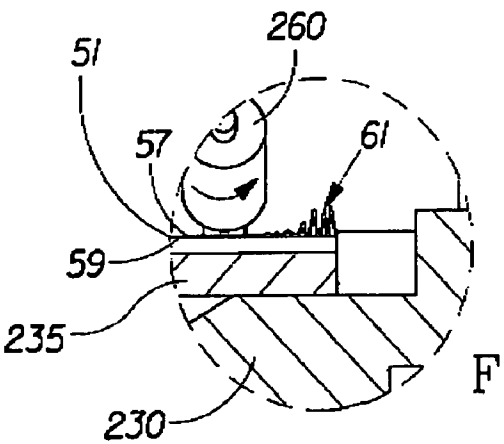
FIG. 9 is an expanded view of the pleating apparatus.

A close up view of the outer ring 235, plunger 230 and tubular sheet 51 being formed into pleats 61 is shown in FIG. 9. The apparatus 200 also preferably comprises a pleat retaining means 260 to restrain movement of a formed pleat 61, whereby the outer ring 235 of the plunger 230 does not engage either the inner surface 57, the outer surface 59, or both of the tubular sheet 51 when the plunger 230 moves from the base position 232 to the forward position 234. A preferred pleat retaining means 260 can comprise two or more wheels made of a pliant material, such as silicone or rubber, that contact either the inner surface 57, the outer surface 59, or both of the tubular sheet 51, and which will rotate freely in a first direction with the tubular sheet 51 as it is pulled by the plunger 230 toward the base position 232, but which will not rotate in the opposite direction, whereby the tubular sheet 51 is prevented by friction with the wheels from moving forward as the plunger 230 returns to the forward position 234.

The outer ring 235 may comprise a plurality of tabs or fingers extending radially outward, whereby the outer edges of the tabs define the circumference of the outer ring. Preferably, the circumference of the outer ring is about 1 to about 4 mm less than the inside circumference of the tubular sheet 51. The plunger shape and circumference can have a circular, elliptical or oval shape. The reciprocating means can be positioned either forward of the plunger 230, or towards the base end of the plunger 230, and preferably comprises an electromechanical or pneumatic device that drives the connector through a concentric. The length of the reciprocating stroke can be adjusted to define the size of the pleats 61. The pack of layered pleats 61 is pushed toward the base end of the mandrel as successive pleats 61 are formed. Alternatively, the central mandrel can have a plurality of slots formed therein, through which the tabs of the outer ring can extend, whereby the pleated tubular sheet 51 is pulled over the mandrel toward the base end of the mandrel.

The plunger 230 preferably comprises a plurality of apertures through which air can flow as the plunger moves backward and forward within the tubular sheet 51, which prevents the air displaced by the plunger from inflating the tubular sheet 51 on the forward stroke and from collapsing the tubular sheet 51 by vacuum on the backward stroke. An indexing means moves either the mandrel 220 in the base position 232, or moves the plunger 230 and reciprocating means 250 in the forward position, by an incremental distance equal to the thickness of each pleat 61, thereby avoiding compression of the layers of pleats 61 as the plunger 230 pulls the tubular sheet 51 toward the base position 232. This apparatus has several advantages. It is simple and inexpensive to construct, and the number of moving parts are few, thereby reducing both maintenance and spare parts. Alternatively, the length of flexible tubular sheet can be arranged in a radially folded manner, as described in European Publication 0,005,660-A1, hereby incorporated by reference.

Method of Forming Closed Individually Packaged Articles

The present invention provides for an improved method for manually forming a closed individually packaged article 105 from the tubular sheet 51. The improved method is particularly convenient and effective for the disposal of waste-containing disposable absorbent articles.

As shown in FIG. 2, the leading portion 52 includes the initial circumferential edge of the tubular sheet 51. The leading portion 52 is brought up out of the storage space 30 through the annular gap 33 of the inlet opening 23 at the inlet end 12 of the device 10. The leading portion 52 is gathered together and closed forming a gathered leading portion 53 that is designed to be sufficiently closed to resist and prevent the closed portion from later prematurely loosening and opening. Tying a simple knot in the end, or by clamping or taping the gathered portion tightly can close the leading portion 52. In a preferred embodiment where the tubular sheet has an adhesive applied to the inner surface 57 (which is the surface facing inward after the tubing has been inserted into the passageway), the gathered leading portion 53 is self-closing with the adhesive. The leading portion 52 extends down into the passageway 25. The leading portion 52, together with the tubular sheet 51 that trails behind, forms the pouch 60 for receiving the article 100 when it is gathered together to form the gathered leading portion 53.

As shown in FIG. 3, inserting the gathered leading portion 53 and the receiving pouch 60 are designed to be located inside the passageway 25. The tubular sheet 51 that forms the pouch 60 extends upward and outward over the inlet core rim 37. The article 100 to be packaged is then inserted down into the device 10 and into the receiving pouch 60. The receiving pouch 60 can hold one or more than one article 100, or large number of smaller articles 100, combined into a single package. In the case of waste-containing disposable diapers, for example, two diapers (or more, depending the diaper size and the size of the device) could be inserted into the receiving pouch 60.

As shown in FIG. 4, a trailing portion 62 of tubular sheet 51 that extends behind the pouched article 100 is then gathered behind the article 100 to close the tubular sheet 51 and form the gathered trailing portion 63 and the individually packaged article 105. The gathering can be accomplished manually be many well-known means, as by twisting the article in the pouch, or by pulling the circumference of the tubular sheet 51 together, or by bringing together opposing sides of the tubular sheet 51. Most simply, the users inserts a hand (or fingers) in through the outlet opening, and grasps by hand and twists the individually packaged article to gather and close the trailing portion of the tubular sheet 51. FIG. 4 shows a packaged article 105 with a leading portion 52 and trailing portion 62 formed into gathered leading portions 53 and gathered trailing portions 63 respectively, just prior to separating the trailing portion 62 to then form a packaged article 105 and a new gathered leading portion. The new gathered leading portion is formed from what once was the gathered trailing portion 63.

To assist in the effective gathering and closing of the trailing portion of the tubular sheet, the device may optionally comprise a gather compression means to exert forces upon the gather, thereby forming a better closure of the sheet. The gather compression means is particularly useful with tubular sheets using certain non-resilient flexible films such as low density polyethylene (LDPE), high density polyethylene (HPPE), and linear low density polyethylene (LLDPE) or combinations thereof, which retain a shape after being manipulated thereto under force, or with tubular sheets having an adhesive on at least one surface which can bind to itself or to other portions of the tubular sheet and create a strong closure and an effective seal. A preferred gather compression means comprises a slot 78 having narrowly-spaced and/or tapered confronting sidewalls 76, which compress against the gathered tubular sheet as the gather is pulled into the slot 78 and cut with a cutting blade 74, as shown in FIG. 1. A preferred gather compression means has confronting sidewalls having a radial width of more than 3 mm, preferably more than 5 mm. The width of the confronting sidewalls 76 creates a more secure gathered trailing portion 63, facilitates the cutting by the cutting means 70 through the gathered trailing portion 63 to ensure that the gathered leading portion 53 and the gathered trailing portion 63 of the closed individually packaged article remains closed and sealed.

To ensure the gathered portion remains closed, a securement means can be used. Effective means for securing the closure include adhesives, adhesive tapes, ties, etc. Suitable adhesive tapes include film tapes and paper tapes. The device 10 can optionally comprise an integral tape dispenser for dispensing a piece of tape to be used to close the gathered tubular film at each end of the article. Once the trailing portion 63 is separated from the tubular sheet 51 and the device 10, the trailing portion may also be tied into a knot to secure the article 100 in the pouch 60.

In a preferred embodiment, the closed individually packaged article is sealed with air-tight, leak-proof closures or seals. In this embodiment, the tubular sheet 51 is preferably a thermoplastic vapor-impermeable film material. The leak-proof package and seals work both ways: to keep any liquids, odors (and malodors), or gases inside the package from escaping, and to keep any moisture or gases in the environment from entering into the package. Particularly preferred, for both its simplicity and effectiveness, is a tubular sheet 51 of a self-sealing adhesive tubular film, which can securely enclose, contain, and seal the article without separate closure means. The selection of adhesive should take into account the adhesives softening temperature and other properties to ensure that the seal can be sustained at even extreme ambient temperatures (both hot and cold). A method for testing the security of the seals is described in the Closure Integrity Method, hereinafter described.

After forming the closed packaged article 105, the method comprises separating the packaged article 105 from the further trailing portion 64 of tubular sheet 51. A separate means of cutting through the tubular sheet trailing portion 62, such as the use of scissors or a knife, are options to the user, though are inconvenient and highly undesirable when traveling outside the home. A means for separating the packaged article 105 from the device 10 has two advantages. It allows for immediate and convenient disposal of the packaged article. It allows the packaged article to be packaged a second time with the same device, thus further controlling odor and improving sanitation. Separating the package article from the device also provides a convenient opportunity to tie a knot in the tubular sheet trailing portion 62 after separation. A knot can be a very effective final sealing technique. More conveniently, the method comprises separating the article by gathering the trailing portion 62 to form a gathered trailing portion 63 and cutting through the gathered trailing portion 63 using a cutting means 70, such as the cutting blade 74 as shown in FIG. 3.

Closure Integrity Method

The test the security of a seal formed by the gathered, closed tubular sheet 51, the following method may be used to exert a positive pressure inside the closed individually packaged article to determine the pressure at which the seal will fail; that is, the pressure differential at which the gathered closure will un-gather or loosen, thereby permitting air inside the packaged article to escape.

A sample of the packaged article 100 within a tubular sheet 51 with both ends gathered and closed, is prepared, and placed in the fixture test stand of a SKYE 2000 equipment (Modem Controls, Inc.) to measure the rupture pressure of the seals of the sample. A sealing septum is applied to the tubular sheet 51 and a hollowed needle that is part of the test stand equipment is inserted generally in the middle of the packaged article through the hole in the septum. A controlled supply of compressed air is attached to the needle inlet. The required rate of increase of pressure is selected from a maximum range of 120 psig/minute to a minimum rate of 6 psig/minute, depending on the package type. Very slowly, the internal pressure inside the closed packaged article is increased from +0 psig/minute to 6 psig/minute (310 mm Hg) (where "psig" is pounds force gauge per square inch) until one or the other seal fails and air begins to leak from the interior of the packaged article through the seal. The internal pressure at which the seal(s) fails is recorded.

Clean, unsoiled baby diapers are selected as the article. Three types of film are used: 1) commercially available Saran® plastic wrap, formed into a tubular film, 2) polyethylene plastic bag (1 mil or 25 microns thick), and 3) a three-dimensional formed film (0.5 mil or 13 microns thick) having a pressure sensitive adhesive applied to one surface (Impress® sealable plastic wrap, available from The Procter & Gamble Company), formed into a tubular film.

Test samples using the Impress® sealable plastic wrap and using the Saran® plastic wrap are formed into closed individually packaged articles, according to the present invention, using two full turns of the closed gather tubular sheet 51 at each end. Samples using the polyethylene plastic bag are placed into the bags, and the open end of the bag is tied in a knot.

Ten samples for each film are tested. The articles closed using the Saran® plastic wrap maintain a seal up to an average internal pressure differential of +0.1 psig (+5 mm Hg), before the gathered seal at one end or another fails. The closed packaged articles using the Impress® sealable plastic wrap maintain a seal up to an average internal pressure differential of +0.8 psig (+41 mm Hg), before the gathered seal at one end or another fails. The closed packaged articles using the polyethylene plastic film bags maintain a seal up to an average pressure differential of +0.7 psig (+36 mm Hg), before one of the bag side seams ruptures. A preferred minimum average internal pressure differential is about +20 mm Hg or more. More preferably, the minimum average internal pressure differential is from about +20 mm Hg to about +100 mm Hg.

A particularly preferred packaged article 105, using pressure-sensitive adhesive on one surface of the tubular sheet 51 with a manually twisted, gathered closure on either side of the article on the leading portion 52 and the trailing portion 62, can maintain an airtight seal at an ambient temperature of 35° C. with an internal differential pressure of about 0.5 psig (+26 mm Hg).

An airtight seal ensures that during a typical use period, odors (including malodors) do not penetrate out through (or in through, as the case may be) the closed seal. Although a plastic film used as the tubular sheet can provide a barrier to the penetration of odors out through the plastic film itself such films are generally not completely odor-proof. To some degree, molecules of odiferous compounds can migrate through the thickness of a plastic film, and can be perceived by a person in the vicinity. It has been found that the presence of the adhesive material applied to a surface of the tubular sheet provides an additional barrier to the penetration of odors through the tubular sheet, thereby significantly reducing the opportunity for odiferous materials within the individually packaged article to pass outside and be perceived by a person in the vicinity.

The present invention may be readily adapted to many product forms and is intended to cover all such changes and modifications that are within the scope of this invention in the following claims.

What is claimed is:

1. An article packaging device comprising:

an inlet end, an outlet end, a body formed by an inner core having an inlet opening and an outlet opening, and a passageway therebetween, a casing comprising a casing wall around the body, the casing joined to the body with a storage space between them, and a tubular sheet within the storage space, the tubular sheet dispensable through a dispensing opening between the body and the casing and into the inlet opening of the inner core and wherein said tubular sheet comprises an adhesive on at least a portion of said tubular sheet, wherein the casing or the storage space comprises a slot, wherein said slot is adapted for compressively gathering said tubular sheet as the sheet is inserted and moved through said slot, whereby the compressive gathering of said tubular sheet causes said adhesive to bond said tubular sheet to itself along its gathered portions in order to close and seal a first packaged article and form a new gathered leading edge of a second packaged article.

2. The article packaging device according to claim 1, wherein the slot comprises a cutting means for cutting through the trailing portion of the tubular sheet to form a packaged article.

3. The article packaging device according to claim 1, wherein the tubular sheet includes a leading portion, a trailing portion and an inner surface, the inner surface comprising an adhesive material, whereby the leading portion and the trailing portion are closeable about at least one article located therebetween with the adhesive material, thereby forming a packaged article.

4. The article packaging device according to claim 1, wherein the tubular sheet comprises a three-dimensional film having an inner surface that comprises a plurality of recessed pressure sensitive adhesive sites and a plurality of collapsible protrusions that serve as stand-offs to prevent premature sticking of the adhesive sites to a target surface until a force sufficient to collapse the protrusions has been applied to the opposed surface of the film.

5. The article package device according to claim 4, wherein the article to be packaged is a waste-filled disposable absorbent article.

6. The article packaging device according to claim 1, wherein the inlet opening is circular or oval.

7. An article packaging device comprising:

an inlet end, an outlet end, a body formed by an inner core having an inlet opening and an outlet opening, and a passageway therebetween, a casing comprising a casing wall around the body, the casing joined to the body with a storage space between them, and a tubular sheet with two surfaces within the storage space, comprising an adhesive disposed on at least one of said surfaces, the tubular sheet dispensable through a dispensing opening between the body and the casing and into the inlet opening of the inner core, wherein the casing or the storage space comprises a slot, wherein said slot is adapted for compressively gathering said tubular sheet as the tubular sheet is inserted and moved through the slot, whereby the compressive gathering of said tubular sheet causes said adhesive to bond said tubular sheet to itself along its gathered portions in order to close and seal a packaged article and form a new gathered leading edge, wherein said slot is further adapted for separating the packaged article from a trailing portion of said tubular sheet as the tubular sheet is inserted and moved through said slot, whereby the separating of the packaged article is performed after each compressive gathering of said tubular sheet such that a series of packaged articles are formed and disposed of in a successive and independent manner.

8. The article packaging device of claim 7, wherein the tubular sheet is in a layered stack.

9. The article packaging device according to claim 7, wherein the tubular sheet comprises a three-dimensional film having an inner surface that comprises a plurality of recessed pressure sensitive adhesive sites and a plurality of collapsible protrusions that serve as stand-offs to prevent premature sticking of the adhesive sites to a target surface until a force sufficient to collapse the protrusions has been applied to the opposed surface of the film.

10. An article packaging device comprising;

an inlet end, an outlet end, a body formed by an inner core having an inlet opening and an outlet opening, and a passageway therebetween, a casing comprising a casing wall around the body, the casing joined to the body with a storage space between them, and a tubular sheet with two surfaces within the storage space, comprising an adhesive disposed on at least one of said surfaces, the tubular sheet dispensable through a dispensing opening between the body and the casing and into the inlet opening of the inner core, wherein the casing or the storage space comprises a slot, wherein said slot is adapted for compressively gathering said tubular sheet as the tubular sheet is inserted and moved through the slot, whereby the compressive gathering of said tubular sheet causes said adhesive to bond said tubular sheet to itself along its gathered portions in order to close and seal a packaged article and form a new gathered leading edge, and wherein the device has a compact dimension of a height along a vertical axis less than 20 centimeters and a width along a horizontal axis of less than 17 centimeters.

11. The article packaging device of claim 10, wherein the tubular sheet is in a layered stack.

12. The article packaging device according to claim 10, wherein the tubular sheet comprises a three-dimensional film having an inner surface that comprises a plurality of recessed pressure sensitive adhesive sites and a plurality of collapsible protrusions that serve as stand-offs to prevent premature sticking of the adhesive sites to a target surface until a force sufficient to collapse the protrusions has been applied to the opposed surface of the film.

* * * * *

UNITED STATES PATENT AND TRADEMARK OFFICE

CERTIFICATE OF CORRECTION

PATENT NO. : 7,395,646 B2
APPLICATION NO. : 10/010391
DATED : July 8, 2008
INVENTOR(S) : Nabil Enrique Salman et al.

It is certified that error appears in the above-identified patent and that said Letters Patent is hereby corrected as shown below:

Title Page

(73) Assignee: delete "Procters" and insert -- Procter --.

Column 6

Line 63, after thereof insert -- . --.

Column 7

Line 1, after thereof insert -- . --.

Column 14

Line 64, after itself insert -- , --.

Column 16

Line 32, delete ";" and insert -- : --.

Signed and Sealed this

Thirteenth Day of January, 2009

JON W. DUDAS
*Director of the United States Patent and Trademark Office*